US010004345B1

(12) United States Patent
Vukkisila

(10) Patent No.: US 10,004,345 B1
(45) Date of Patent: Jun. 26, 2018

(54) CULINARY DISH FORMED OF PALM LEAF AND REMOVABLE COVER

(71) Applicant: Suresh Vukkisila, Folsom, CA (US)

(72) Inventor: Suresh Vukkisila, Folsom, CA (US)

( * ) Notice: Subject to any disclaimer, the term of this patent is extended or adjusted under 35 U.S.C. 154(b) by 0 days. days.

(21) Appl. No.: 14/706,525

(22) Filed: May 7, 2015

(51) Int. Cl.

| | |
|---|---|
| ***A47G 19/02*** | (2006.01) |
| ***B65D 43/10*** | (2006.01) |
| ***B65D 25/54*** | (2006.01) |
| ***B65D 43/02*** | (2006.01) |
| ***B65D 55/02*** | (2006.01) |
| *A47G 19/03* | (2006.01) |

(52) U.S. Cl.
CPC ..... *A47G 19/02* (2013.01); *B65D 25/54* (2013.01); *B65D 43/02* (2013.01); *B65D 55/02* (2013.01); *A47G 2400/10* (2013.01); *B65D 2543/00296* (2013.01)

(58) Field of Classification Search
CPC .... A47G 19/03; A47G 19/02; A47G 2400/10; B65D 1/34; B65D 1/26; B65D 25/54; B65D 43/02; B65D 55/02; B65D 2543/00296
USPC ..... 220/574, 4.21, 4.24, 781, 784
See application file for complete search history.

(56) References Cited

U.S. PATENT DOCUMENTS 3,964,635 A * 6/1976 Ludder ..... B65D 43/0212 220/784
4,805,797 A * 2/1989 Natori ..... B65D 43/0212 220/315
5,984,130 A * 11/1999 Hayes ..... B65D 1/34 206/508
6,120,863 A * 9/2000 Neculescu ..... B29D 7/01 220/4.21
6,601,723 B1 * 8/2003 Ziglar ..... A47B 43/00 220/4.28
8,584,929 B2 * 11/2013 Littlejohn ..... B65D 1/34 220/574
8,701,930 B2 * 4/2014 Mithal ..... B65D 43/0212 220/4.21
2006/0278634 A1 * 12/2006 Wong ..... B65D 43/0212 220/4.21

(Continued)

OTHER PUBLICATIONS www.verterra.com; VerTerra Disposable Dinnerware; Apr. 28, 2015.

(Continued)

*Primary Examiner* — J. Gregory Pickett
*Assistant Examiner* — Niki M Eloshway
(74) *Attorney, Agent, or Firm* — Heisler & Associate

(57) ABSTRACT

The dish is formed by pressing a palm leaf to form a generally concave dish with a floor surrounded by sides extending to an upper edge. A rim extends laterally from this upper edge, formed as a unit with the floor and sides of the dish. A lid is provided which has a top surface with side walls extending down to a perimeter latch. This perimeter latch engages the dish, such as by snapping onto the rim. In one embodiment the perimeter latch extends downwardly from other portions of the lid and has at least one indentation which extends inwardly thereon to provide an upper recess above the indentation which is sized to receive a tip of the rim. A height of the upper recess is oversized relative to a thickness of the tip of the rim to accommodate some variation in dish thickness and some degree of dish warping.

10 Claims, 4 Drawing Sheets

(56) References Cited

U.S. PATENT DOCUMENTS

| | | | | |
|---|---|---|---|---|
| 2007/0007165 | A1* | 1/2007 | Weder | B65D 21/086<br>206/584 |
| 2010/0155396 | A1* | 6/2010 | Warner | B65D 1/0215<br>220/4.24 |
| 2010/0203198 | A1* | 8/2010 | Yoakim | A47J 31/22<br>426/80 |
| 2011/0309088 | A1* | 12/2011 | Chao | A47G 19/00<br>220/574 |
| 2015/0000536 | A1* | 1/2015 | Lang | A47J 36/00<br>99/359 |

OTHER PUBLICATIONS

Christal Enterprises; Bio plates and cups made out of areca barks; Mar. 21, 2011; India.
Multicare Marketing; 100% biodegradable & eco-friendly plates and dishware made out of dry palm leaf sheaths; May 2, 2010; India.
Areca Leaf Products; areca palm dishes; Feb. 16, 2010; India.

* cited by examiner

CULINARY DISH FORMED OF PALM LEAF AND REMOVABLE COVER

FIELD OF THE INVENTION

The following invention relates to dishes upon which food can be placed for presentation and also eating directly therefrom. More particularly, this invention relates to dishes which include a removable lid placeable thereon and which dishes are formed of organic material, such as pressed palm leaves.

BACKGROUND OF THE INVENTION

Culinary dishes can be formed from a variety of different materials and have a variety of different shapes. The shapes can vary from a plate-like dish which is almost entirely flat, but typically has a rim which extends slightly higher than a floor, to a dish that is more in the form of a bowl, with a rim significantly higher than a floor of the dish. Dishes can be round, square, rectangular, or other shapes.

Dishes can be formed of durable materials which can be readily sanitized so that the dishes are generally reusable, or can be formed to be disposable. Disposable dishes are convenient, especially when provided with food thereon for sale. A purchaser can potentially eat the food off of the disposable dish and then dispose of the dish without having the burden of washing and storing the dish until ready to be used again. However, disposable dishes increase the waste which ends up either requiring recycling or dumping into a landfill.

Some materials are known which are compostable and/or biodegradable. For instance, some wood pulp or wood fiber pressed materials (such as in the form of fiberboard or thick craft paper or cardboard materials) are known which can meet various different criteria for at least some degree of biodegradability or compostability. Such paper based materials are not entirely satisfactory for display and sale of food items thereon because the material, being somewhat water soluble, will to some degree absorb moisture in the food item being presented, and cause discoloration and/or sogginess of the dish.

One highly effective and fully compostable and biodegradable material has more recently been known to be formed into a dish which is formed of palm leaves of the areca palm. When leaves of the areca palm are pressed under high pressure between plates having a shape with a gap between the plates similar to a desired shape for a plate, and with such pressing also occurring with the application of heat and/or moisture, the leaf is pressed into a dish shape. The areca leaf has some degree of waxiness naturally present therein which leaves the pressed leaf dish with a natural coating which resists absorption of moisture sufficient to avoid "sogginess" even when wet food items are placed thereon. As a further benefit, such dishes formed of palm leaves only require the application of pressure, heat and/or steam to be formed into a dish. No chemicals or other additives are required, so that full compostability and full biodegradability and food grade usability is obtained. Furthermore, the leaf pressed into a dish form maintains a desirable organic appearance, with lines apparent therein and a color thereof, as well as a texture which readily conveys to the user that the dish is formed of a natural organic material.

One problem which has been encountered with the manufacture of dishes from pressed palm leaves is that the variable nature of the input stock placed into the press leaves the dish with some degree of variableness in thickness, perimeter contour, and a degree to which an upper edge of the side walls terminates within a single common plane. While such variability adds uniqueness and interest to such dishes, this variability and the upwardly extending upper edges of the sides of such prior art dishes have made it impractical to form a lid which can effectively attach to such dishes, especially with a reliability that a lid will attach to all or substantially all dishes, rather than having a high failure rate due to the variability in the final shape of such prior art dishes.

Lids are important for many situations. For instance, when food items are presented for sale in a store or restaurant it is often desirable for the food items to have a cover. This cover is often in the form of a clear plastic lid which is removable from the dish. A clear plastic cover allows a purchaser to see the food item through the lid, and yet have confidence that other shoppers have not handled the food item directly because the lid has protected the food item, and also that flies or other flying insects have been kept from contact with the food items. Accordingly, a need exists for a pressed leaf dish which can have a sufficiently uniform contour at a perimeter thereof that a lid can attach effectively thereto, and a need also exists for a lid appropriately modified to accommodate some degree of variability in the thickness and flatness of perimeter portions of the dish, so that a lid can be provided which can effectively attach to a pressed leaf dish.

SUMMARY OF THE INVENTION

With this invention a dish is provided and also a cover which can attach to the dish and be secured thereto in a removable fashion, even when the dish has some degree of variability in thickness thereof and flatness of perimeter portions thereof. The dish utilizes areca palm leaves which are pressed between platens to form the dish of the final desired shape. While examples shown herein are rectangular or square, other shapes could be provided by merely modifying the shape of platens used to form the dish. Various sizes can also be accommodated by changing sizes of the platens.

Uniquely with this invention, a perimeter of the dish is not left as an upwardly extending upper edge of sides which extend up from a floor. Instead, a rim is provided which extends substantially laterally from upper edges of the sides to a lateral side defining a tip of the rim. The rim, so located and configured, provides a structure to which a perimeter latch on a lid can effectively attach.

The dish is formed by having appropriately shaped top and bottom platens pressed together upon an areca palm leaf (or potentially leaves or other organic leaf-like structures, preferably also along with the addition of heat and steam) to produce the final dish with the desired shape. The original shape and thickness of the leaf will cause variability of the dish at the rim in at least two ways. First, a thickness of the rim between a top side and an underside will vary somewhat based on a thickness of the original leaf material placed into the press. Second, based on the original geometry of the leaf, and other factors, such as variability in moisture content of the leaf, after the leaf material comes out of the press it may warp to some extent so that the rim is not entirely planar.

For instance, if the dish is square, first and third corners diagonally opposite each other might be higher than second and fourth corners diagonally opposite each other and in-between the first and third corners. Such a warping shape will cause the rim to be slightly non-planar. Standard prior art lids with perimeter latches thereon cannot accommodate such rim thickness variability and rim warpage. Rather, this thickness variability and warpage will cause prior art lids to have a high failure rate where the lid might initially be placed onto the dish, but then have at least one corner thereof pop off of the rim of the dish. If such failure occurs when the lid is first put on, a user has the undesirable but possible option of discarding the dish and selecting a second dish which has a more uniform shape. However, the lid can often pop off after the passage of some time, especially when food items stored therein are placed within a refrigerated location, where the temperature change will over time apply forces associated with thermal contraction of the lid and dish at different rates, which along with the shape of the lid and warpage and thickness variation of the dish will cause connection failure.

With this invention, a lid is provided which accommodates the thickness variation and warpage within the dish so that all or substantially all dishes can have the lid securely held thereto. In particular, a perimeter latch of the lid extends downwardly from side walls which extend down from a top surface of the lid. This perimeter latch has at least one indentation which extends laterally inwardly from a primary downwardly extending perimeter latch structure. An upper recess is provided above this at least one indentation. The upper recess is carefully sized to have a height dimension between the indentation and upper portions of the perimeter latch which extend inwardly before connecting to the side walls which extend down from the top surface. This height of the upper recess is sized to be greater than a thickness of the rim of the dish at the tip thereof. This oversizing of the upper recess is preferably about fifty percent greater than a thickest anticipated rim for the dish. Thus, this upper recess accommodates warpage in the rim without requiring the perimeter latch of the lid to itself warp along with the dish to remain attached thereto. In this way, a lid of a single highly uniform size can fit dishes which have a close to uniform size but exhibit some variability due to the natural character thereof.

OBJECTS OF THE INVENTION

Accordingly, a primary object of the present invention is to provide a dish which is formed of a natural material, such as a palm leaf material, and which can function effectively as a dish, even accommodating a cover, such as a lid thereon.

Another object of the present invention is to provide a lid for a dish having some variability in perimeter shape, which lid can attach securely to dishes of this somewhat variable geometry.

Another object of the present invention is to provide an assembly for display of food which is attractive to purchasers.

Another object of the present invention is to provide a food display dish and lid combination which includes a fully biodegradable and compostable dish portion.

Another object of the present invention is to provide a dish and lid combination which has a clear lid through which a food item and the dish can be clearly seen.

Another object of the present invention is to provide a lid for a dish which lid has a perimeter latch which can accommodate warped dishes and/or dishes having perimeter rims of variable thickness.

Another object of the present invention is to provide a method for display of a food item upon a pressed palm leaf dish having a somewhat variable perimeter geometry under a lid of standardized shape.

Other further objects of the present invention will become apparent from a careful reading of the included drawing figures, the claims and detailed description of the invention.

DESCRIPTION OF THE PREFERRED EMBODIMENT

Figure 1:
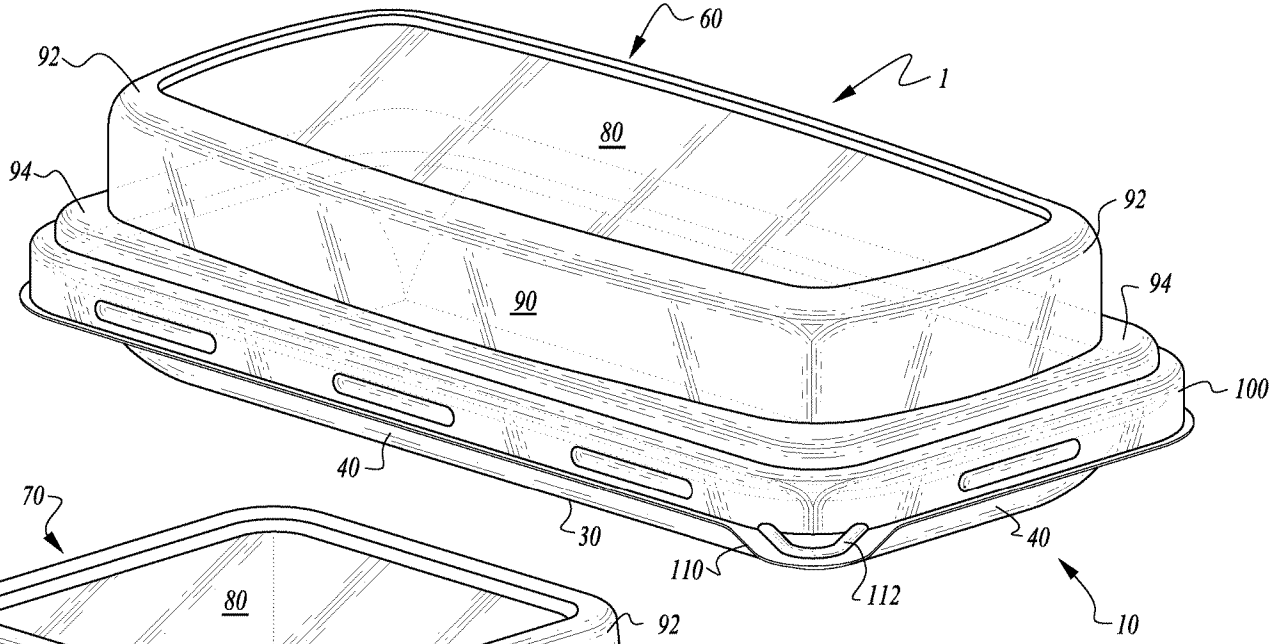
FIG. 1 is a perspective view of a rectangular assembly including a rectangular dish and a rectangular lid with the lid attached to the dish.
Figure 2:
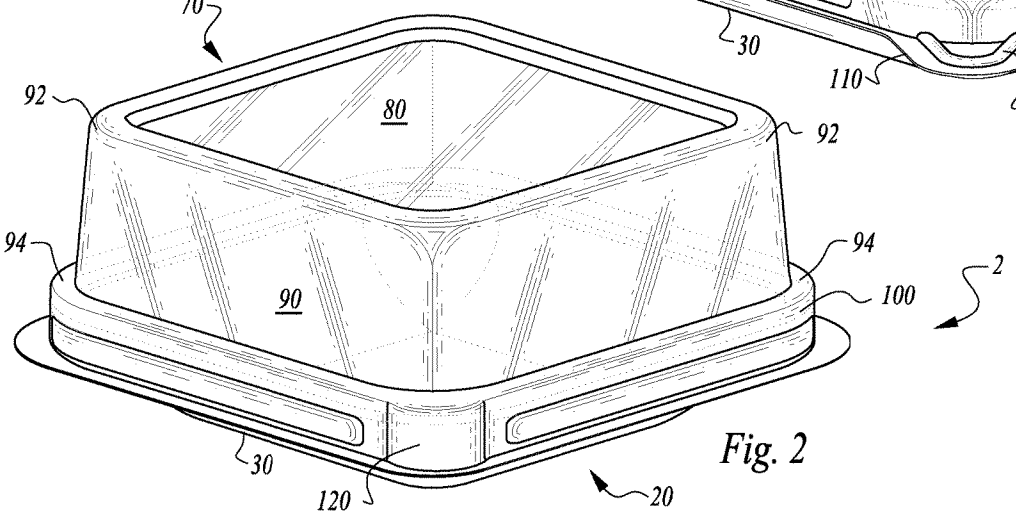
FIG. 2 is a perspective view of a square assembly including a square dish and a square lid attached together.
Figure 3:
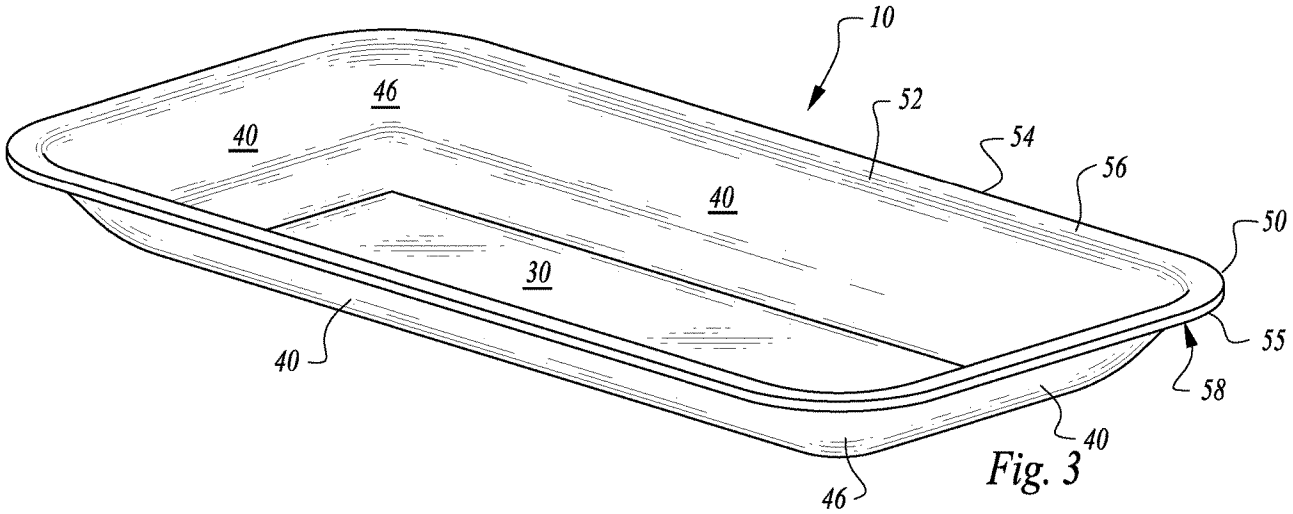
FIG. 3 is a perspective view of the rectangular dish of FIG. 1 with the rectangular lid removed.
Figure 4:
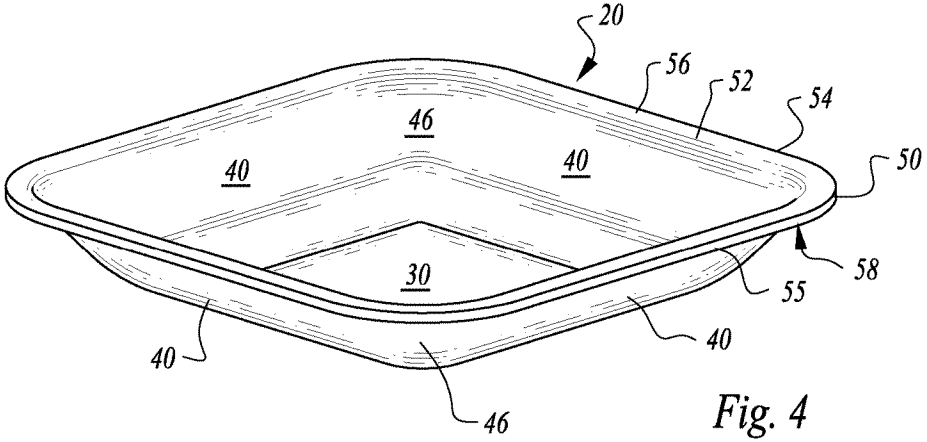
FIG. 4 is a perspective view of the square dish of FIG. 2 with the square lid removed.
Figure 5:
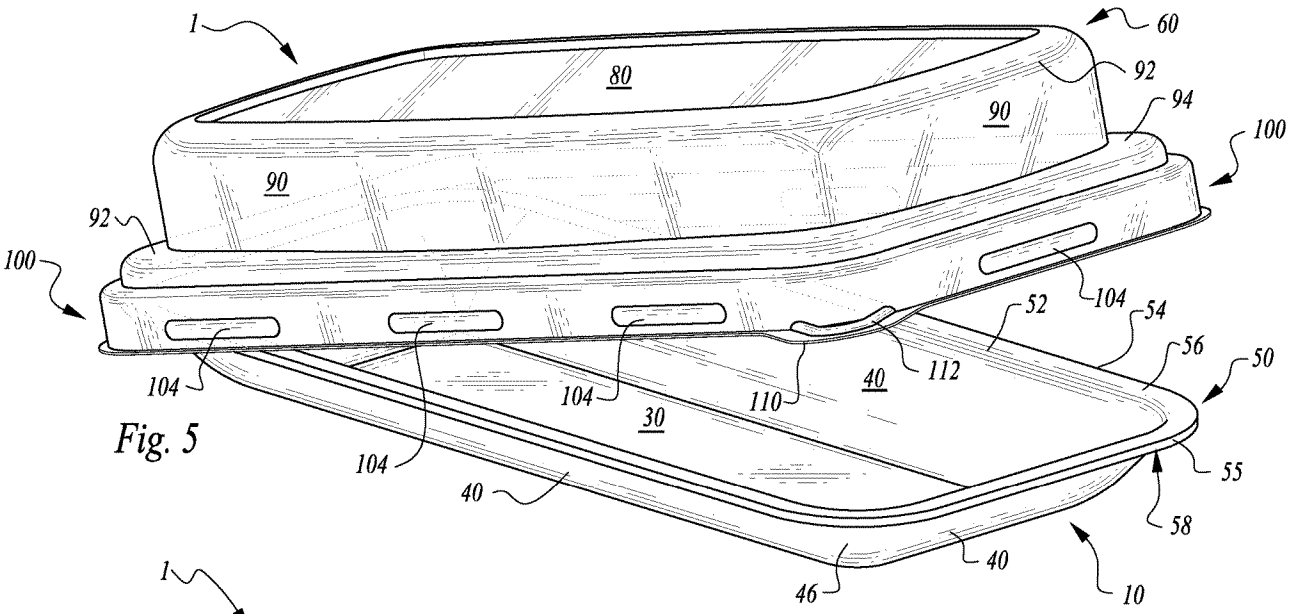
FIG. 5 is a perspective view of that which is shown in FIG. 1, with the rectangular lid shown partially removed off of the rectangular dish.

Referring to the drawings, wherein like reference numerals represent like parts throughout the various drawing figures, reference numeral 10 is directed to a rectangular dish (FIG. 3) which can have a rectangular lid 60 (FIG. 5) removable attached thereto to provide a rectangular assembly 1 (FIG. 1). An alternative embodiment square assembly 2 is also shown (FIG. 2) with a square dish 20 (FIG. 4) and a square lid 70 removably attachable to the square dish 20. The dish is preferably formed by pressing of an areca palm leaf between platens to form the final dish shape. The lid is provided with a perimeter latch 100 which accommodates some variability in thickness and contour of the rim 50 of the dish 10, 20 so that a standard size lid 60, 70 can attach to a rim 50 of the dish 10, 20 when it has some variability in geometry.

In essence, and with particular reference to FIGS. 1 and 6-8, basic details of the invention are described, according to a preferred embodiment. To accommodate variability in perimeter structure of the dish, such as the rectangular dish 10, both the dish 10 and the lid 60 are modified from prior art dishes and lids. The dish 10 has a floor 30 which is generally planar and has sides 40 which extend up from this floor 30 to upper edges 44. Rather than having the upper edges 44 terminate in an upwardly extending direction, a laterally extending rim 50 is provided at the upper edge 44 of the sides 40. This rim 50 extends to a lateral side 55 which defines a tip of the rim 50.

The rectangular lid 60 has a top surface 80 with side walls 90 extending downward therefrom to a perimeter latch 100. The perimeter latch 100 has a geometry including an upper recess 102, which is sized to accommodate a rim 50 having variable thickness, and which can be warped out of a fully planar form by having the upper recess 102 oversized. A lid 60 of standard dimensions can thus attach to dishes 10 which have some variability in thickness at the rim 50 and some variability in the planar form of the rim 50, while still allowing the lid 60 to remain securely attached to the dish 10 until removal is desired by a user.

More specifically, and with particular reference to FIGS. 1-4, basic details of the dishes 10, 20 and lids 60, 70 are described, according to various embodiments. The rectangular dish 10 and square dish 20 are identical in form except that a top plan shape thereof is either rectangular (for the rectangular dish 10) or square (for the square dish 20). This illustrates how dishes 10, 20 of different geometries can still feature the details of this invention for holding a lid 60, 70 to the dish 10, 20. Common reference numerals are utilized for details of the rectangular dish 10 and square dish 20, where the only difference therebetween is the shape thereof being rectangular or square.

The dish 10 is shown herein having a plate-like form which is quite shallow between a substantially planar floor 30 at a lower portion thereof and extending through sides 40 which extend upwardly from the floor 30. In this embodiment, the sides 40 curve upwardly from a lower edge 42 adjacent the floor 30 to an upper edge 44 opposite the lower edge 42. In other embodiments, the sides 40 could extend upwardly in a planar fashion. A height of the sides 40 could be greater or less than that depicted for the sides 40. For instance, if the dish 10 is to be configured more as a bowl, the sides 40 would be taller, and generally steeper. If the dish 10 is to be more in the form of a flatter plate, the sides 40 could extend upwardly at a more gradual angle and/or to a lesser extent up from the floor 30.

Uniquely with this invention, the sides 40 terminate at a rim 50 adjacent the upper edge 44. This rim 50 is formed as a unitary mass along with the sides 40 and floor 30. In a preferred embodiment, this forming occurs by pressing an areca palm leaf between upper and lower platens having a gap therebetween similar in shape to a desired contour for the dish 10. Platens of different shapes can be provided, such as to provide the square dish 20, or to provide different sizes. While generally square and rectangular dishes are shown herein, the platens could be shaped to produce generally round dishes as an alternative, or other shapes.

The rim 50 extends substantially horizontally away from the upper edge 44 of the sides 40. In a preferred embodiment, this rim 50 completely circumscribes the dish 10. Particular details of the rim 50 are described in detail below.

Lids such as the rectangular lid 60 are provided having a standardized form. Most preferably, the lid 60 is formed of at least partially transparent material, such as plastic. In one embodiment, the plastic is vacuum formed plastic. The lid 60 generally has a top surface 80 which is substantially planar and with side walls 90 extending down from the top surface 80. A perimeter latch 100 is located at a lower end of the side walls 90. This perimeter latch 100 is shaped to removably attach to the rim 50 of the dish 10.

Side walls 90 of the lid 60 can have a variety of different shapes. In the embodiment shown, the side walls 90 have a curving transition 92 adjacent the top surface 80 which transitions into a vertical surface. This vertical surface then transitions to a horizontal surface which forms a step 94 extending laterally somewhat further than other portions of the side walls 90. Lower portions of the step 94 transition into the perimeter latch 100 which defines a greatest diameter perimeter of the rectangular lid 60. Other geometries for the side walls 90 could also be provided.

If a larger or taller food item is to be placed upon the dish, a height of the side walls 90 can be increased. While the top surface 80 is shown generally flat, it could be domed or have other shapes. While the side walls 90 are shown vertical over large portions thereof, the side walls 90 could maintain a lateral taper between the top surface 80 and the perimeter latch 100, rather than having vertical portions thereon. While the step 94 can add some rigidity to the lid 60, the step 94 could be avoided or multiple steps 94 could be provided or other undulating or other structures provided within the side walls 90, either for structural strength or to add a desirable and interesting appearance to the lid 60. Details of the perimeter latch 100 for coupling to the rim 50 are described in detail below.

Figure 6:
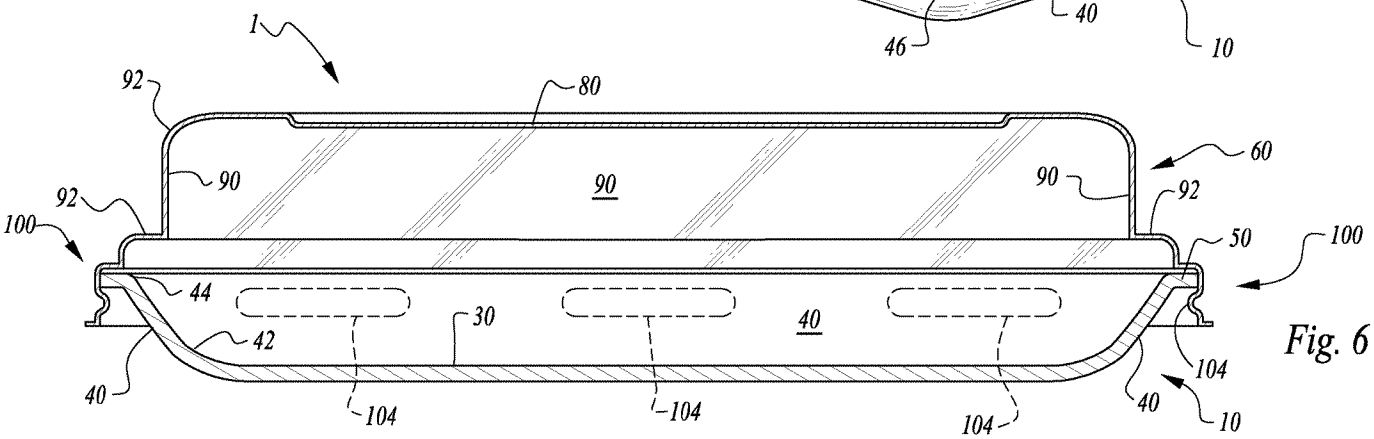
FIG. 6 is a side elevation full sectional view of that which is shown in FIG. 1, illustrating how the rectangular lid attaches to the rectangular dish at a perimeter latch on the rectangular lid.
Figure 8:
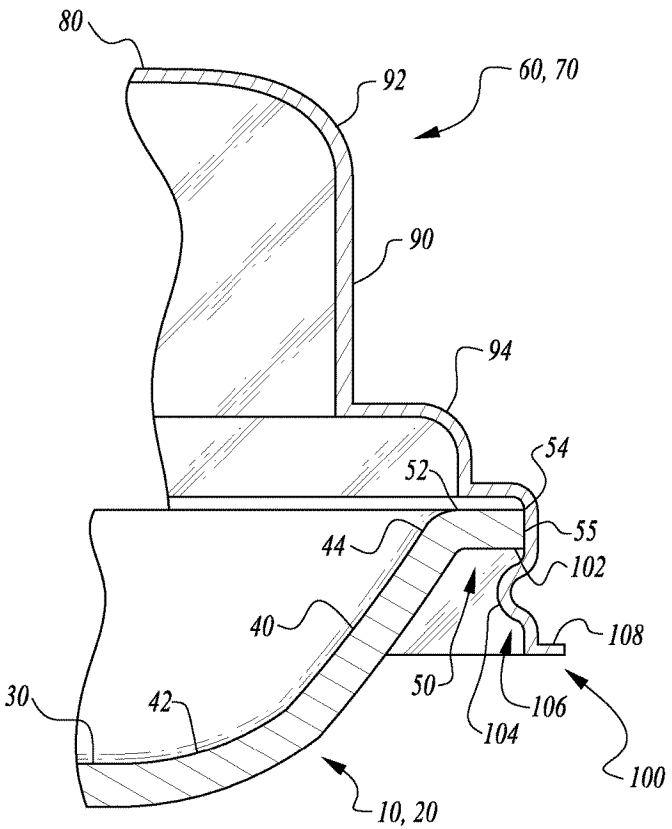
FIG. 8 is a detail of a portion of that which is shown in FIG. 6, showing how the perimeter latch of the lid attaches to a rim of the dish.
Figure 7:
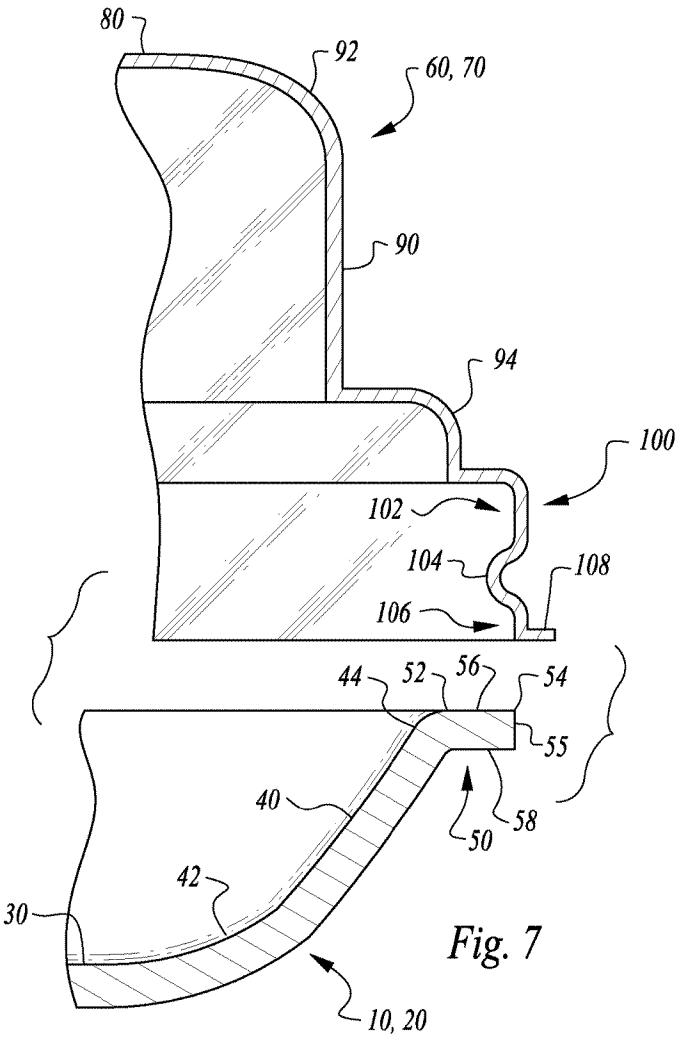
FIG. 7 is a detail of a portion of that which is shown in FIG. 7, with a portion of the lid exploded off of a portion of the dish.

With particular reference to FIGS. 6-8, details of the rim 50 and perimeter latch 100 are described which cooperate together to allow the lid 60 to attach to the dish 10, even when the dish 10 has some variability in thickness and flatness according to a preferred embodiment. The rim 50 has an inner edge 52 adjacent the upper edge 44 of the sides 40. An outer edge 54 is provided opposite the inner edge 52. The rim 50 has a top side 56 extending between the inner edge 52 and the outer edge 54. An underside 58 is provided opposite the top side 56 and also extending from the inner edge 52 to the outer edge 54. A lateral side 55 preferably is oriented vertically and extends between the top side 56 and underside 58 at the outer edge 54. This lateral side 55 defines a tip of the rim 50 defining a greatest diameter of the rim 50 and a greatest diameter of the dish 10.

The lateral side 55 is formed typically by some form of cutting procedure. For instance, the platens which form the dish 10 can have cutters at edges thereof, such as with a top platen having a sharp cutting edge and the bottom platen having a reference surface against which the cutting edge can abut, so that the lateral side 55 of the rim 50 is formed at the same time that other portions of the dish 10 are formed. Alternatively, the lateral side 55 of the rim 50 can be formed in a separate secondary procedure to trim the rim 50 and provide the lateral side 55.

Depending on the original thickness of the particular areca palm leaf or other organic matter placed within the press, including the density and moisture content of the leaf material, a final thickness of the rim 50 at the lateral side 55 can vary to some degree. For instance, if the lateral side 55 is designed to be two millimeters thick, it might actually vary between 1.5 millimeters and 2.5 millimeters in thickness. Furthermore, after the dish 10 has been formed, in a process that involves application of steam, heat and pressure, some degree of "memory" in the areca palm leaf or other material, or potentially structural characteristics of the leaf material itself (such as the degree to which some portions of the leaf material are able to absorb steam or not, and the orientation of the leaf material within the press) can cause the dish to warp somewhat after removal from the press.

Such warpage is typically hardly noticeable, but causes the top side 56 of the rim 50 to be less than entirely planar. Because this warpage is quite small, it is not visible in the drawings shown herein. While the warpage can involve only a single corner or side being higher or lower than other portions thereof, in other situations, two opposite corners might be elevated and two other opposite corners might be lowered with such a warped rim 50. Such a warped rim 50 might have a height differential between lower corners or sides and higher corners and sides which might vary one to two millimeters from each other.

Lid 60 materials, such as vacuum moldable plastic materials, have a small amount of flexibility which can accommodate some degree of warpage or variability in rim 50 thickness. However, there are limits to the degree to which such lids can accommodate such warpage. Thus, to provide a lid 60 which can attach to dishes 10 which may have an unacceptably wide range of warpage or rim 50 thicknesses, the perimeter latch 100 of the lid 60 is configured to accommodate this variability.

In particular, the perimeter latch 100 extends downwardly from lowermost portions of the side walls 90 to define both a lowermost and outermost portion of the lid 60. This perimeter latch 100 is generally vertical except where at least one indentation 104 extends inwardly thereon and at a lowermost edge where a horizontal tab 108 optionally but preferably extends outwardly therefrom. Importantly, an upper recess 102 is provided between the indentation 104 and upper portions of the perimeter latch 100. A lower recess 106 is provided below the indentation 104 which ends at the horizontal tab 108 and the lower edge of the perimeter latch 100.

The upper recess 102 has a particular height and depth. The height is measured between upper portions of the at least one indentation 104 and upper portions of the perimeter latch 100. A depth of the upper recess 102 is generally similar to a depth of the indentation 104 extending laterally in from other substantially vertical portions of the perimeter latch 100. The at least one indentation 104 is shown as a plurality of elongate discrete indentations 104 with gaps therebetween in the rectangular dish 10 of FIGS. 1 and 5-7. The square dish 20 shows a more continuous single indentation within the perimeter latch 100 thereof.

The depth of the upper recess 102 formed by the depth of the indentations 104 is carefully selected so that the perimeter size of the rim 50 at the lateral side 55 thereof can snap past the indentations 104 and into the upper recess 102, and the process can be reversed by snapping the lateral side 55 of the rim 50 out of the upper recess 102 for removal of the lid 60. In one embodiment, this depth of the upper recess 102 is provided at four millimeters by having indentations 104 extend four millimeters inward from vertical portions of the perimeter latch 100. The perimeter latch 100 can be positioned at a location which is two millimeters greater than a diameter of the rim 50 at the lateral side 55. In this way, two millimeters of tolerance are provided which can accommodate variations such as thermal contraction and expansion differences between the material forming the lid 60 and the dish 10, while still having two millimeters of the rim 50 held within and above the indentation 104 within the upper recess 102 of the perimeter latch 100.

The height of the upper recess 102 is preferably sized to be greater than a typical maximum thickness of the rim 50 at the lateral side 55. For instance, if the lateral side 55 could be as large as 2.5 millimeters, the upper recess 102 would have a height which is greater than 2.5 millimeters. In a most preferred embodiment the upper recess 102 has a height which is fifty percent greater than a maximum typical thickness of the rim 50 at the lateral side 55. Thus, if a maximum typical thickness of the lateral side 55 of the rim 50 is 2.5 millimeters, the upper recess 102 would have a height of 3.75 millimeters. In this way, the upper recess 102 both accommodates variability in thickness of the rim 50 and also warpage of the rim 50 to some extent.

In addition to accommodating warpage by oversizing of the upper recess 102, the lid 60 can to at least a small degree warp along with the dish 10 so that the perimeter latch 100 can remain attached to the dish 10 at the rim 50. Furthermore, the lid 60 can be sufficiently strong so that to some extent it can "de-warp" the dish 10 somewhat and still have the perimeter latch 100 of the lid 60 remain securely attached to the rectangular dish 10, and also be readily removable and re-attachable to the dish 10 by a user.

In some instances, a dish 10 will have a rim 50 which is not warped and will have a thickness at the lateral side 55 of the rim 50 which is not oversized. In such an instance, the lid 60 may exhibit a small amount of looseness, but the depth of the upper recess 102 is sufficiently great that such looseness is not sufficient for the lid 60 to come off of the rim 50 of the dish 10, so that substantially all extremes of variability in the geometry of the dish 10 are accommodated by the configuration of the perimeter latch 100 of the lid 60.

The perimeter latch 100 preferably has a substantially uniform configuration around an entire perimeter of the lid 60. However, most preferably a corner grip 110 is provided where a horizontal tab 108 at a lowermost edge of the perimeter latch 100 extends further laterally than other portions of the perimeter latch 100, and is preferably located at a corner of the lid 60. A rib 112 is inboard and on top of this corner grip 110 which can add some rigidity to the corner grip 110. The corner grip 110 provides a location where a user can grip the lid 60 and apply an upward force focused at this corner to separate the perimeter latch 100 from the rim 50, so that the lid 60 can be removed from the dish 10.

Similarly, the square dish 20 and square lid 70 accommodate removal of the square lid 70 by providing a corner relief 120 at a corner of the square lid 70. This corner relief 120 is somewhat less rounded than other corners so that a user can insert a finger under the corner relief 120 and grab the rim 50 and then use the finger (or some tool such as a handle of a spoon, fork or knife) to pivot upwards and separate the square lid 70 from the square dish 20. The corner relief 120 and corner grip 110 could be swapped for each other on the dishes 10, 20 or different corners of a common dish 10, 20 could be provided with either the corner grip 110 or the corner relief 120. To some extent, the corner relief 120 can also provide a small amount of ventilation if desired for an interior of the dish 10, 20 beneath the lid 60, 70, such as to reduce condensation therein, but preferably sufficiently small to prevent flies or other flying insects from passing into this enclosure.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A palm leaf dish with removably attachable lid, comprising in combination:

a unitary mass of pressed palm leaf formed into a generally concave shape with a substantially constant average thickness between an upper surface and a lower surface;

said mass including a floor and sides extending up from said floor to an upper edge;

a rim at said upper edge of said sides, said rim extending laterally from said upper edge of said sides to a tip;

wherein said lid is attachable to said dish, said lid having a top surface with side walls extending downwardly from said top surface to a perimeter latch locatable adjacent to and securable to said tip of said dish;

wherein said latch includes a recess sized at least as large as said tip vertically and sized similar to said rim such that said perimeter latch can fit upon said rim when said lid is brought adjacent to said rim of said dish;

wherein said recess has a height at least as great as about fifty percent more than a thickness of said tip;

said rim having an average total height between a lowermost portion of said rim and an uppermost portion of said rim that is less than about fifty percent as high as said height of said recess; and whereby said recess is oversized to accommodate irregularities in said total height of said rim of said pressed palm leaf material.

2. The dish of claim 1 wherein said lid is at least partially formed of clear plastic material.

3. The dish of claim 1 wherein said tip has a substantially constant thickness between a top side and an under side; and wherein said latch includes a recess sized at least as large as said tip vertically and sized similar to said rim such that said perimeter latch can fit upon said rim when said lid is brought adjacent to said rim of said dish.

4. The dish of claim 3 wherein said perimeter latch includes at least one indentation extending inwardly on said perimeter latch, said recess for said tip located as an upper recess above said at least one indentation; and wherein said recess is taller than a thickness of said tip of said rim.

5. The dish of claim 1 wherein said pressed palm leaf material remains in a natural uncoated state.

6. A palm leaf dish and lid combination, comprising:

a unitary mass of pressed palm leaf formed into a generally concave shape with a substantially average constant thickness between an upper surface and a lower surface;

said mass including a floor and sides extending up from said floor to an upper edge;

wherein said lid is attachable to said dish, said lid having a top surface with side walls extending downwardly from said top surface to a perimeter latch locatable adjacent to and securable to said tip of said dish;

wherein a rim is provided at said upper edge of said sides, said rim extending laterally from said upper edge of said sides to a tip;

wherein said latch includes a recess sized at least as large as said tip vertically and sized similar to said rim such that said perimeter latch can fit upon said rim when said lid is brought adjacent to said rim of said dish;

wherein said perimeter latch includes at least one indentation extending inwardly on said perimeter latch, said recess for said tip located as an upper recess above said at least one indentation;

wherein said recess has a height at least as great as about fifty percent more than a thickness of said tip;

said rim having an average total height between a lowermost portion of said rim and an uppermost portion of said rim that is less than about fifty percent as high as said height of said recess; and whereby said recess is oversized to accommodate irregularities in said total height of said rim of said pressed palm leaf material.

7. The combination of claim 6 wherein said tip has a substantially constant thickness between a top side and an under side; and wherein said recess is taller than a thickness of said tip of said rim.

8. The dish of claim 6 wherein said pressed palm leaf material remains in a natural uncoated state.

9. A palm leaf dish and lid combination, comprising:

a unitary mass of pressed palm leaf formed into a generally concave shape;

said mass including a floor and sides extending up from said floor to an upper edge;

wherein said lid is attachable to said dish, said lid having a top surface with side walls extending downwardly from said top surface to a perimeter latch locatable adjacent to and securable to said tip of said dish;

wherein a rim is provided at said upper edge of said sides, said rim extending laterally from said upper edge of said sides to a tip;

wherein said latch includes a recess sized at least as large as said tip vertically and sized similar to said rim such that said perimeter latch can fit upon said rim when said lid is brought adjacent to said rim of said dish;

wherein said perimeter latch includes at least one indentation extending inwardly on said perimeter latch, said recess for said tip located as an upper recess above said at least one indentation;

wherein said recess has a height at least as great as about fifty percent more than a thickness of said tip;

said rim having an average total height between a lowermost portion of said rim and an uppermost portion of said rim that is less than about fifty percent as high as said height of said recess; and whereby said recess is oversized to accommodate irregularities in said total height of said rim of said pressed palm leaf material.

10. The dish of claim 9 wherein said pressed palm leaf material remains in a natural uncoated state.

* * * * *